US006789662B2

(12) United States Patent
Niccolai

(10) Patent No.: US 6,789,662 B2
(45) Date of Patent: Sep. 14, 2004

(54) MODULAR TRACK FOR SUSTAINING AND TOWING LOADS AND THE PANEL REQUIRED TO BUILD IT

(76) Inventor: Nicoletta Niccolai, 6, via Dello Sport, Castellina in Chianti, Siena (IT), I-53011

( * ) Notice: Subject to any disclaimer, the term of this patent is extended or adjusted under 35 U.S.C. 154(b) by 0 days.

(21) Appl. No.: 10/606,214

(22) Filed: Jun. 26, 2003

(65) Prior Publication Data

US 2004/0050669 A1 Mar. 18, 2004

(30) Foreign Application Priority Data

Aug. 1, 2002 (IT) ..... AR2002A0028

(51) Int. Cl.[7] ..... B65G 37/00
(52) U.S. Cl. ..... 198/465.2; 104/172.2
(58) Field of Search ..... 198/465.1, 465.2, 198/860.1, 860.2; 104/172.2, 172.3

(56) References Cited

U.S. PATENT DOCUMENTS 4,801,003 A * 1/1989 Costa ..... 104/172.1
4,947,978 A * 8/1990 Rhodes ..... 198/465.2
5,271,490 A * 12/1993 Sticht ..... 198/465.2
5,299,680 A * 4/1994 Rhodes ..... 198/465.2
5,350,052 A * 9/1994 Gebald et al. ..... 198/465.2
5,884,746 A * 3/1999 Leisner et al. ..... 198/465.2

* cited by examiner

*Primary Examiner*—James R. Bidwell
(74) *Attorney, Agent, or Firm*—Young & Thompson

(57) ABSTRACT

A modular and removable track placed on the ground, comprises a succession of panels, supplied with at least one longitudinal guiding, groove which allows at least one beak, tightly connected to the load to be dragged, to penetrate inside it, to interact with the series of towing elements, one for each panel, and to be guided in running along the track; each towing element being constituted of a longitudinal ring like element, stretched between two spools and furnished with dragging elements, of at least one switch and of the motor connected to one of the spools and activated/deactivated by the switch. Each panel furthermore comprises at least the ducts and for the connections of the switch to the motor and with the fluid dynamic circuit connected at the start of the track with a primary motor, through which at least one motor is activated in one of the panels of the track.

17 Claims, 2 Drawing Sheets

MODULAR TRACK FOR SUSTAINING AND TOWING LOADS AND THE PANEL REQUIRED TO BUILD IT

BACKGROUND OF THE INVENTION

The invention concerns a modular track for sustaining and towing loads, as well as the panel, a plurality of which generates the track. The track is placed on the ground and it is particularly useful, for example, to carry boats into the water, from the arrival and parking areas and vice versa.

At present the movement of loads in unequipped areas is carried out manually and in some cases with hand pushed trolleys.

Therefore, for example, boats are moved from land to water and vice versa, in part with the aid of trolleys and in part, on the shoreline, by lifting and moving them only with muscle power.

This is possible only in the event in which the loads to be moved are not very heavy or, anyhow are such that a limited number of persons can lift them and move them.

Because of this, when the loads to be moved are heavy it is not possible to move them without the appropriate structures.

In the case of boats, the transport and launching is a complex and tiring job, such as to discourage their transport outside of ports and specifically equipped docks, the use of which though is very expensive.

SUMMARY OF THE INVENTION

The aim of the present invention is the creation of a low price mobile and modular track, that does not require important modifications of the terrain on which it must be placed, which requires minimal maintenance and which allows the operators to transport loads from the arrival areas to the place of utilization and vice versa, quickly and with a minimum of physical effort, allowing a large number of users to utilize the same track or in any case to use it repeatedly.

The invention which has allowed us to reach the said results consists of a mobile and modular track, placed on the ground, of a length that is in any case ample, created with a series of panels, furnished with at least one longitudinal guiding groove through which to allow at least one jutting beak, firmly connected to the load to be drawn, to penetrate inside it, to interact with a succession of towing means, one for each panel, and to run guided along the track; each towing means being constituted by a longitudinal ring like element, stretched between two spools and furnished with dragging hooks, by at least one switch and by the motor connected with one of the said spools and activated and deactivated by said switch. Furthermore, each panel comprises at least the ducts for the connection of the said switch with the said motor and with the fluid dynamic circuit which is connected, at the beginning of the track, with a primary motor, from which, during its operation, at least one motor in one of the panels on the said track is activated.

Said invention, as described in detail herebelow, is particularly advantageous in that:

- it is easy to produce and has a low cost;
- it allows the track to be as long as required, with a minimum of modification to the terrain on which it must be installed;
- the panels that compose it are easily assembled together, without requiring especially qualified personnel, making the assembly and disassembly of the track easy;

- it allows a fast mobilization of the loads, eventually laid on appropriate trolleys, therefore their rapid transport, thus permitting the use of the same track by a plurality of persons or, anyhow, its repeated use.

BRIEF DESCRIPTION OF THE DRAWINGS

Other advantages will become evident from the detailed description that follows, referred to the preferred embodiment, exemplified in the drawings in the enclosed tables which.

DESCRIPTION OF THE PREFERRED EMBODIMENTS

Figure 1:
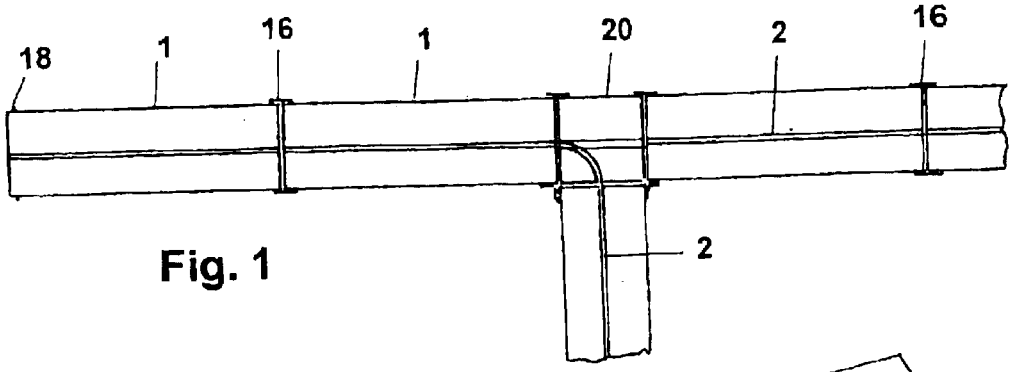
FIG. 1 is the plan view of the modular track with a side track.
Figure 2:
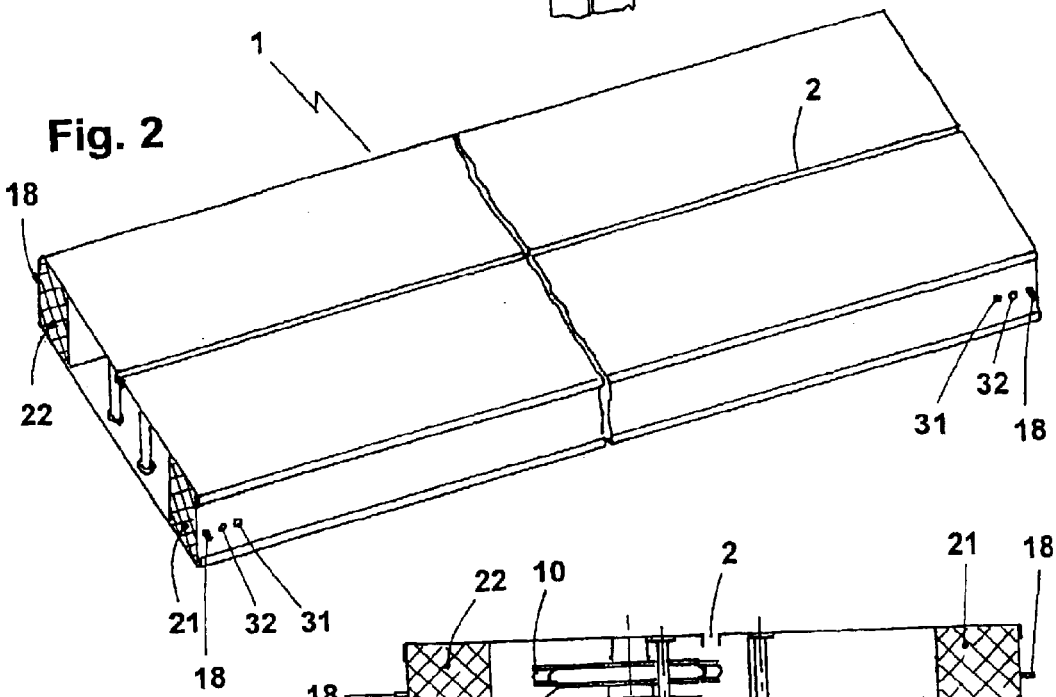
FIG. 2 is the axonometric view, on a different scale, of the panel, with which the track in FIG. 1 is created.

It is understood that the drawings have an exemplifying character only, with the only aim of aiding the comprehension of the logic that governs the technical operation of the track, and of one of the embodiments of the panel, with a plurality of which the track is built, these drawings do not constitute in any way a limitation to the invention.

In substance the invention consequently consists of a track on which one can transfer loads, in particular trolleys with boats, from one loading/unloading station to a second one, such as, for example, the sea or a lake into which the boat is placed to allow its use, then to reload it onto the trolley and move it back to the parking area or to the place where it will be loaded onto an appropriate vehicle for its transport by road.

Said track is a movable and modular structure, made up of a succession of panels 1 placed on the ground, furnished with at least one longitudinal guiding groove 2, within which to insert the beaks 3 jutting from the load, or from the trolley carrying the load to be transferred, normally two, where the front one is longer and the back one shorter as defined herebelow.

Inside each panel 1 which makes up the track, there is a towing means 6 with means 10 for dragging the beaks 3, with the longitudinal ring like element 7, a cable, a chain or other equivalent means, stretched between two spools 8 and 9, at least one of which, normally the one identified with the number 8, is connected to a motor 12 combined with a switch 11 and with the ducts 13 and 19, through which the switch 11 and the motor 12 associated to it, are connected to the forward moving duct 14 and the return duct 15 of the fluid dynamic circuit, connected to the first feed motor, normally at the beginning of the track. Each switch 11, normally one for each towing means 6, is appropriate for connecting and disconnecting the corresponding motor 12 from the fluid dynamic circuit activated by the primary motor.

The sustaining and towing track for loads is therefore composed of a plurality of panels 1 connected to each other in a sequence, one after the other, by means of hinges 16. These allow the panels to change their position on the plane containing the longitudinal guiding groove 2 to allow them to lie as close as possible to the ground on which the track is laid down.

In one embodiment the panels 1 have, on their ends, side jutting pins 18 which have threaded extremities with which appropriate plates with holes and specific nuts allow their flexible connection in sequence. In another embodiment each panel 1 has at one end, two jutting pins, on the other end two wings that prolong it on the side, each wing having a groove for housing the corresponding jutting pin of the adjacent panel in the sequence.

The sequence which is interrupted by shunting segments 20, interposed between the panels 1 adjacent in the points in which the track branches out, furnished with a longitudinal and a curved groove, coinciding in the initial tract. Said segments 20 permit the creation of side branches in respect to the main direction of the track.

The track described in the single groove embodiment, permits a single directional movement of the load on it. In this case with appropriate variations of the hooks or dragging means 10 or with the inversion of the flow of the fluid in the circuit 14–15, activated by the primary motor, the direction of the dragging movement of the load 4 can be inverted.

In the embodiment with two transmission directions on the same track, there are two longitudinal grooves 2 on it, one next to the other, while inside each panel 1, in one case, there are two distinct series of towing means 6 capable of determining the dragging action of the load in the two opposite directions. In this solution each direction of movement is supplied with its own fluid dynamic circuit, activated by the same primary motor or by two separate primary motors. In another solution, the two grooves on each panel correspond to the two branches of the longitudinal ring like element of the towing means which, with one branch pushes the load beaks in one direction and with the other branch it pushes the load beaks in the opposite direction. Essentially, at the basis of the operation of the track in question is panel 1 with a plurality of which the track is built.

Said panel 1, in the embodiment exemplified in the drawings, has a biscuit like structure, therefore a parallelepiped shape, for example 120 cm wide, 14 cm thick and 600 cm long.

On said structure there are two side strips 21 and 22 that are resistant to the compression exercised by the load 4 to be moved, or the wheels of the trolley which supports the same load. Towards the middle of the track there is a longitudinal groove 2, through which the beak or beaks 3, jutting from the load or the trolley to be dragged and guided, can be inserted inside.

Inside panel 1 is housed the towing means 6 with its longitudinal ring like element 7, for example a strong rope, stretched between two spools 8 and 9, one of which, is normally motorized. Said towing means 6 is furnished with hooks or other dragging means 10 and with its own deactivation beak 33.

One of the two spools 8 and 9 is activated by a fluid dynamic motor 12 on whose feeder duct there is a switch 11, for example of the four arm type, capable of allowing or blocking the flow of fluid of the motor of the forward moving duct 14 towards the return duct 15, through the motor 12 associated with spool 8.

Each panel 1 is equipped with means 16 and 18 for the mechanical connection in sequence of the same panels 1 and with the connection means of the ducts 14 and 15 corresponding to them, activated by the primary motor.

Figure 3:
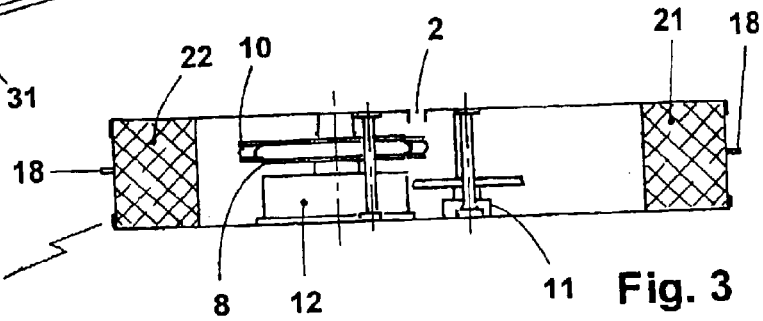
FIG. 3 is the front longitudinal view, on a different scale, of the panel in FIG. 2.
Figure 4:
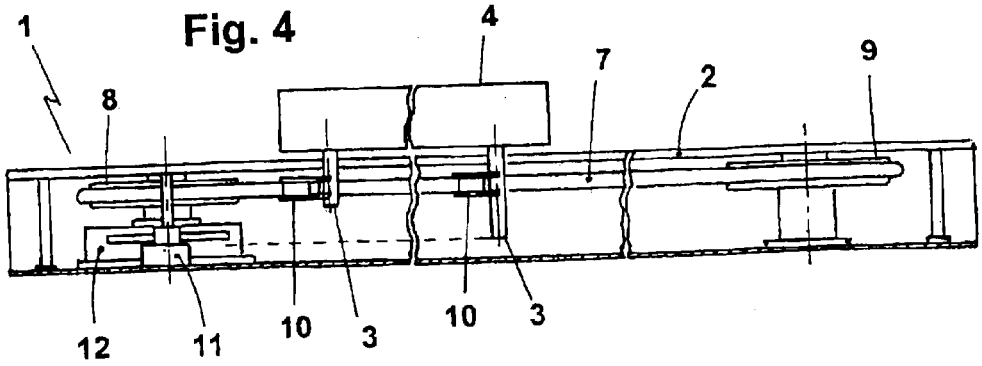
FIG. 4 exemplifies the side view of the panel and of its internal structure, as well as of a load with the two beaks inserted in the longitudinal groove of the panel, pushed by two jutting hooks of the longitudinal element of the dragging means.
Figure 5:
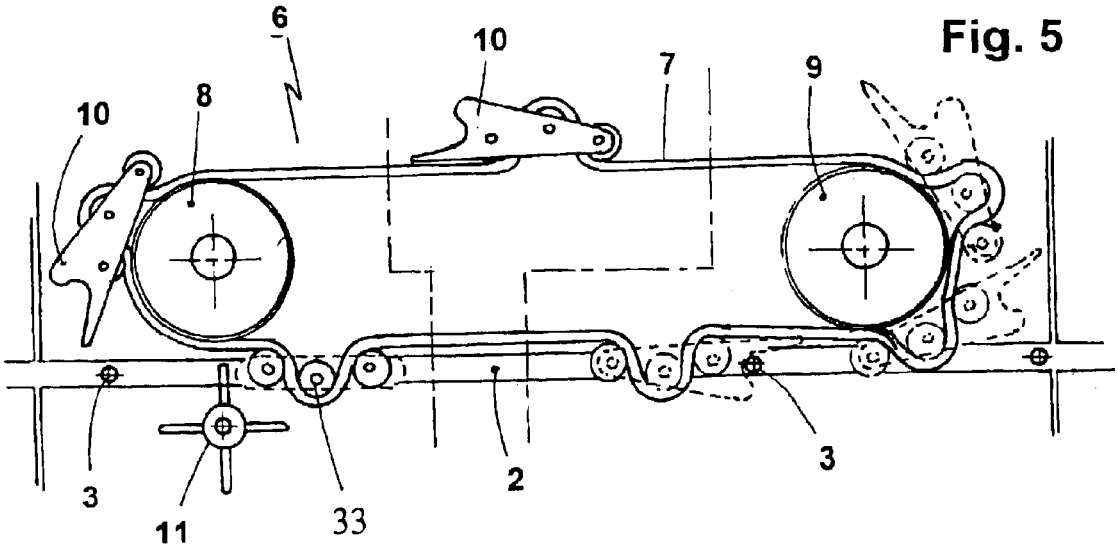
FIG. 5 exemplifies, on a different scale, the plan view of the towing means inside the panel of FIG. 2, with indications, by means of a dotted line drawing, some of the positions that the hook-shaped dragging means can assume around the second spool of the longitudinal ring like element of the structure.
Figure 6:
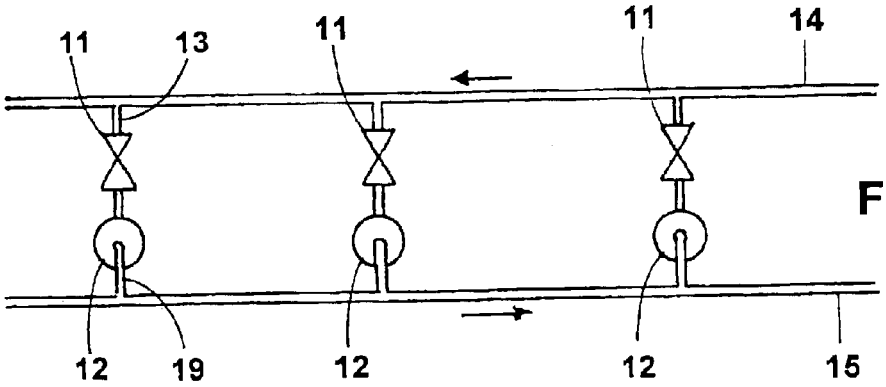
FIG. 6 exemplifies, in a schematic shape, the fluid dynamic mechanism which activates the towing means inside the panels placed in succession.
Figure 7:
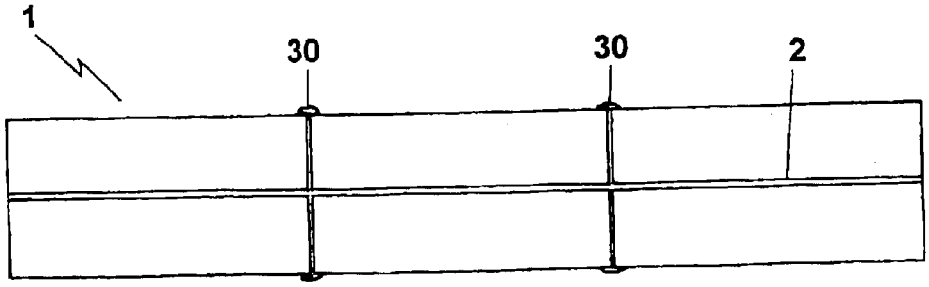
FIG. 7 is the top plan view of a panel with the joints.
Figure 8:
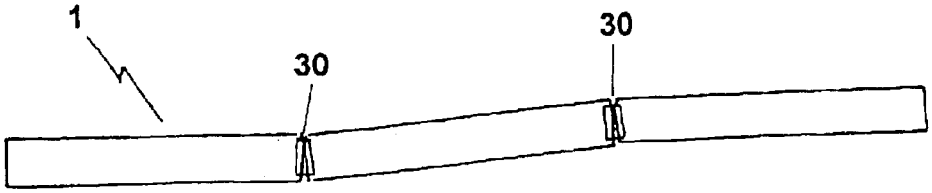
FIG. 8 is the side elevational view of the panel in FIG. 7.

In the embodiment exemplified in FIGS. 3, 4 and 5, panel 1 has, inside it, towing means 6, with the longitudinal ring like element 7, stretched between two spools 8 and 9 equipped with two jutting hooks 10 capable of interacting with beaks 3 of load 4 or of the trolley on which the load is placed, as for example a boat.

The beaks 3 are inserted in the longitudinal groove 2 of panel 1; the towing means 6, along with the two dragging hooks 10, also has its own beak 33 which can move switch 11 to the inactive or blocking position in respect to the motor 12, of the flow of the pressurized fluid originating from the duct 14 of the primary motor.

The two hooks 10 of the towing means 6 are capable of interacting with the two beaks 3 of load 4 and exercise a pushing action on them. Said hooks 10 are therefore separated by at least a distance that is equal to that between beaks 3 jutting from load 4, or from the trolley to be towed and on which the load will be laid.

Beak 33 which is part of towing means 6, precedes the first hook 10 by a distance which enables it to deactivate switch 11 of panel 1 a little before the first hook 10 reaches the longitudinal groove 2 of the same panel, predisposing it for the interaction with the first beak 3 of the load which must be towed over said panel, originating from the one preceding it in the direction of the movement of the loads 4 on the track.

In a different embodiment, the beak 33 precedes the first hook 10 by a short distance so that it stops just a little before the switch 11, pushed to a closed position by the same beak 33. In this case hook 10 is placed in groove 2 and is capable of inflecting to allow the passage of the first beak 3 of the arriving load with which switch 11 is activated. In this case, said beak 3, after passing the first hook 10, activates switch 11, therefore the corresponding motor 12, so that said hook 10 starts to move while staying close to said beak 3 to reach it and push it as soon as the towing pressure ceases on load 4, by the towing means 6 of panel 1 which precedes the one of which said hook 10 is part.

The internal motorization of each panel 1, therefore its towing means 6, is capable of interaction with two jutting beaks 3 of load 4 to be guided and dragged. The first of the said beaks 3 has an appropriate length for the activation of switch 11 connected to the internal motor 12 of the same panel 1; the second beak 3 is instead shorter and is capable only of interacting with the jutting hooks 10 of the ring like dragging structure of the said motorization, to receive the pushing and dragging action.

The towing means 6 associated with panel 1, in the described solution, is therefore equipped with hooks and other dragging means 10, with a motor 12 and a switch 11 with four activation arms placed crosswise on a level lower than the dragging hooks 10 and appropriate for activating/deactivating motor 12 of the same towing means 6.

At least some of the panels 1 with which the track is built, have a plurality of joints 30, distributed along their length, which allow them to be placed on the ground along a uneven line, so as to increase their adherence to the same ground in the points where it changes level and decrease the stresses on the same panels 1 at the passage of load 4. The panel in question—having been conceived for being placed in sequence with others—has at its ends the hinge joint means 16–18 for the said connections. Inside it, furthermore, the panel has at least two ducts 14 and 15 for the motor fluid dynamic circuit, normally placed with their extremities 31 and 32 on one of the side edges, and with said extremities capable of allowing, with appropriate external means normally of the rapid spring coupling type, their connection with the corresponding ones of the adjacent panel, so as to give a continuity to the ducts 14 and 15 and therefore to the upload and download branches of the closed circuit on the primary motor.

Panels 1, described in the solution represented in a schematic way in the enclosed drawings, allow therefore the activation and transport of a load 4 in one direction only and according to a defined one.

In this case, to allow a two way transport of the load, two distinct tracks are required, one to allow the upward transport and the other one for the return. In the event in which one track only must be used for towing load 4 in two distinct directions, the solution with two adjacent longitudinal grooves 2 is preferred, each one operating with its own internal transmission. In this case the panel with which to build said track is furnished with two longitudinal grooves and two towing means, each one positioned in correspondence to one of the two longitudinal grooves to operate on beaks 3 of load 4 inserted inside them and activated in opposite directions. In another embodiments the two longitudinal grooves are placed in correspondence to the two branches of the towing means 6 whose hooks 10, or other equivalent towing means, push the beaks 3 in the two planned directions of movement.

During the manufacturing phase the production details may undergo variations, while the functional logic of the invention, as defined by the following claims, is unvaried.

What is claimed is:

1. A modular track for sustaining and towing loads, with which to transfer in a guided mode, a load (4) from a first loading/unloading station to a second utilization station and vice versa, characterized by a modular structure composed of a sequence of panels (1) placed on the ground, by the fact that it is furnished with at least one longitudinal guiding groove (2) within which can be inserted at least one beak (3) emerging from the load (4) to be transferred, with towing means (6) with means (10) for dragging beaks (3), in each panel (1), and with each towing means (6) characterized by the fact that it includes a longitudinal ring like element (7) stretched between two spools (8) and (9) at least one of which is connected to a motor (12) combined with at least one switch (11) of the fluid dynamic circuit, as well as the track being characterized by a forward way (14) and a return way (15) closed on a primary feeder motor, and by the fact that the switches (11), at least one for each towing means (6), are capable of activating or deactivating the corresponding motors (12) from the fluid dynamic circuit.

2. The modular track, as claimed in claim 1, characterized by a sequence of panels (1) connected to each other by means of hinged means (16) (18) which allow them to change direction on the plane containing the longitudinal groove (2).

3. The modular track, as claimed in claim 1, characterized by shunting segments (20) interposed between the adjacent panels (1)—placed at the points in which the track branches off—furnished with a longitudinal groove and a curved groove which coincide in the initial tract.

4. The modular track, as claimed in claim 1, characterized by two longitudinal grooves (2) placed next to each other and by two distinct series of towing means (6) with the longitudinal ring like element (7) capable of determining the towing action on the load (4) in the two opposite directions of the same track.

5. The modular track, as claimed in claim 1, characterized by two longitudinal grooves (2) placed next to each other in correspondence with the two branches of the towing means (6), with the longitudinal element (7) capable of pushing the beaks (3) according to the two directions of progression of the load to be transferred.

6. A panel with which to create the modular track for sustaining and towing loads as per claim 1, characterized by two side strips (21) and (22) resistant to the compression exercised by the load (4) to be towed, by at least one longitudinal groove (2) placed towards its centre, by at least one towing means (6) furnished with a longitudinal ring like element (7) stretched between two spools (8) and (9) one of which is motorized, and furnished with dragging means (10), with at least one switch (11), with motor (12), associated with the spool (8), as well as said panel being characterized by the means (16) and (18) for its mechanical connection in sequence with other panels (1) and by the extremities (31) and (32) for the connection with the correspondent upload duct (14) and download duct (15) in the joined panels (1).

7. The panel, as claimed in claim 6, characterized inside by a towing means (6) having a longitudinal ring like element (7) stretched between two spools (8) and (9) and equipped with dragging means (10), adequate to interact with the beaks (3) of load (4) inserted inside the longitudinal groove (2), and with its own deactivating beak (33) through which it moves the switch (11) from the active to the inactive position.

8. The panel, as claimed in claim 7, characterized by the fact that the dragging means (10) of the towing means (6) are separated by a distance between them which is at least equal to the distance between the beaks (3) jutting from the load (4) to be dragged.

9. The panel, as claimed in claim 7, characterized by the fact that the deactivating beak (33) of said towing means (6) precedes the first dragging means (10) by at least the distance that will enable it to deactivate the switch (11) just before the first dragging means (10) reaches the longitudinal groove (2) inside the panel (1).

10. The panel, as claimed in claim 7, characterized by the fact that the deactivating beak (33) of said towing means (6) precedes the first dragging means (10) by very little in order to stop just before the switch (11), and said dragging means (10) being made to bend to allow the passage of the first beak (3) of the arriving load (4) with which the switch (11) is activated.

11. The panel, as claimed in claim 6, characterized by a towing means (6) appropriate to interact with the two beaks (3) jutting from the load (4) which needs to be directed and towed, the first of which has a length that enables it to activate the switch (11) associated with the motor (12) inside the panel (1), while the second one is shorter and is appropriate to interact only with dragging means (10) of the longitudinal ring like element (7) of the towing means (6).

12. The panel, as claimed in claim 6, characterized by towing means (6) which include the longitudinal ring like element (7) with dragging means (10), the motor (12), the switch (11) having crosswise activation arms at a level which is lower than that of the dragging means (10).

13. The panel, as claimed in claim 6, characterized by several joints (30) distributed along its length, adequate to enable it to be laid on the ground in an uneven line.

14. The panel, as claimed in claim 6, characterized by two longitudinal grooves (2) and two towing means (6) with the longitudinal ring like element (7) each one is placed in correspondence with one of the two longitudinal grooves (2) to operate on the beaks (3) inserted inside them with towing movements in opposite directions.

15. The panel, as claimed in claim 6, characterized by two longitudinal grooves (2) placed in correspondence with the two branches of the towing means (6) in a position that will enable the dragging means (10) to push beaks (33) in the two foreseen advancing movements.

16. The panel, as claimed in claim 6, characterized on the extremities by hinge means (16) and (18) for the connection in series of the panels (1).

17. The panel, as claimed in claim 6, characterized by at least two ducts (14) and (15) for the fluid dynamic circuit fixed with the extremities (31) and (32) on one of the side edges, with said extremities capable of coupling with the appropriate external means with those of the corresponding adjacent panels.

* * * * *